United States Patent [19]

Turner et al.

[11] Patent Number: 4,489,897

[45] Date of Patent: Dec. 25, 1984

[54] APPARATUS FOR SHREDDING DOCUMENTS

[75] Inventors: Peter J. Turner; Neal J. Morrissey, both of Chicago, Ill.

[73] Assignee: General Binding Corporation, Northbrook, Ill.

[21] Appl. No.: 471,309

[22] Filed: Mar. 2, 1983

[51] Int. Cl.[3] ..... B02C 18/16

[52] U.S. Cl. ..... 241/167; 241/236

[58] Field of Search ..... 83/501, 502, 503, 348; 241/232, 230, 234, 235, 236, 166, 167, 36, 32, 37.5, 190

[56] References Cited

U.S. PATENT DOCUMENTS 4,411,391 10/1983 Crane ..... 241/236 X

FOREIGN PATENT DOCUMENTS 1468662 3/1977 United Kingdom ..... 241/190

2059804 4/1981 United Kingdom ..... 241/236

*Primary Examiner*—Mark Rosenbaum

*Attorney, Agent, or Firm*—Hill, Van Santen, Steadman & Simpson

[57] ABSTRACT

An apparatus for shredding paper by passing the paper or document between a pair of shredding rollers comprising a plurality of spaced cutters characterized by a backup arrangement for at least one of the rollers to prevent bending of the roller and jamming during a shredding operation. The backup arrangement includes at least one yoke member having at least one finger which extends between cutters to engage a spacing portion of the roller to limit the amount of bending thereof so that a document or sheet of paper cannot pass between the rollers without being shredded.

19 Claims, 7 Drawing Figures

APPARATUS FOR SHREDDING DOCUMENTS

BACKGROUND OF THE INVENTION

The present invention is directed to an improved device for shredding documents which device has two rotating members having a plurality of knife-like cylindrical members that are interdigitally mounted to shred a document as it passes therebetween.

In order to destroy documents to preserve their confidentiality, it is known to cut the documents in narrow strips in a process which is commonly referred to as shredding. A specific way of shredding is achieved with circular knives or cutters which are arranged along an axis of a rotating member and coact with a second member having similar knives which are offset so that the knives of one member pass between the rotating knives of the other member. In addition, stripping arrangements are positioned between the rotating knives on each of the two rotating members to insure that the shredded material does not stick.

The actual structure of the rotating members having knives or cutters can be a solid bar of steel or similar material in which the knives and cutters are formed by machining so that the cutter and the spacer are all integral to one another. Another structure has separate cylindrical members of a large diameter which are utilized as the knives or cutters and are spaced apart by separate cylindrical spacers which are assembled on a shaft in an alternating relationship. A third structure is a plurality of sleeves having integral knives and spacers, which sleeves are then assembled on shafts to form the rotating members. The shredding device also has strippers or paper guides which are utilized and extend in the area of the spacer for the purpose of guiding the material into the two rotating members or cutting rolls and also to lead the shredded material out on the discharge side as severed or cut strips.

One problem with known and existing shredding devices is that when overloaded by too thick a stack of documents to be shredded, the shafts or rotating members will be bent or flexed so that the document or paper will pass through in one piece and not be shredded into strips. This passing through of the documents in an unshredded condition will cause jamming which will require taking the machine apart for correction. It has been proposed to provide the shredding device with automatic reversing mechanism so that when the rotating members begin to jam and the speed of the motor is reduced, the drive motor will reverse the direction of rotation of the cutting blades to expel the document. An example of such a system is disclosed in copending U.S. patent application No. 422,282 which was filed Sept. 23, 1982. However, this automatic reversing device may malfunction or be overridden by the operator so that a jamming of the documents can still occur.

SUMMARY OF THE INVENTION

The present invention is directed to an improved shredding device which overcomes problems of jamming known in the prior art devices without increasing the diameter of the shafts or rotating members and thus maintaining manufacturing costs to a minimum without losing the function or sales appeal of the device.

To accomplish these goals, the present invention is directed to an apparatus for shredding paper comprising a frame, a pair of rotatable members, each member having a plurality of first cylindrical portions such as cylindrical cutters and a plurality of second cylindrical portions such as cylindrical spacers alternately arranged along the axis of each of the members with the first cylindrical portions or cutters being of a larger diameter than the second cylindrical portions or spacers to provide annular spaces adjacent the periphery of each second portion and between adjacent first cylindrical portions, means for mounting the pair of members interdigitally in the frame for rotation with the first cylindrical portions or cutters of one of the pair of members being opposite the second portions of the other member of the pair and extending into the annular spaces associated therewith so that the first cylindrical portions or cutters of the pair of rotating members overlap each other and coact to shred material passing between the pair of rotating members, means for rotating said pair of members, stripping means operatively extending into the annular spaces between said rotating members to aid in guiding material to pass between said pair of rotating members and to strip or remove material from said rotating members, and backup means for limiting bending of at least one of the rotating members to prevent jamming of the material during a shredding operation, said backup means including at least one yoke member having at least one finger and means for mounting the yoke member adjacent one of the rotating members and opposite the other rotating member with the finger extending into the, annular space between adjacent first cylindrical portions or parts to a point adjacent the peripheral surface of the second cylindrical portion disposed therebetween so that as the rotating member begins to bend during shredding of material, the finger of each yoke member engages the respective second portion to prevent further bending of the rotating member.

Preferably the means for mounting each of the yoke members comprises a transverse support member which extends substantially parallel to the rotating members. If each rotating member is provided with the backup means, each rotating member has a support member. While each of the yoke members may have only a single finger preferably, they are provided with more than one finger so that they will engage either adjacent second cylindrical portions or closely spaced second cylindrical portions. Preferably, at least two yoke members are utilized for each rotating member. The yoke member can also be formed of a self-lubricating sintered bronze powder metal alloy to insure long life and to enable mounting of the yoke member to be in sliding engagement with the second portion.

DESCRIPTION OF THE PREFERRED EMBODIMENTS

Figure 1:
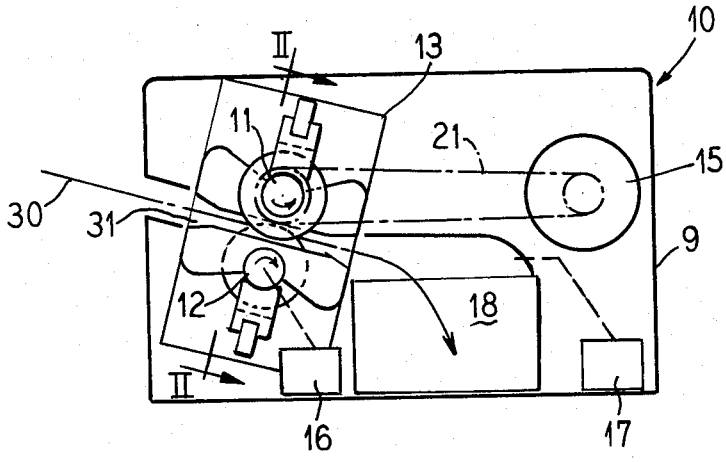
FIG. 1 is a schematic illustration of a shredding device or apparatus in accordance with the present invention.

The principles of the present invention are particularly useful when incorporated in a shredding apparatus or device generally indicated at 10 in FIG. 1. The shredding apparatus 10 has a housing or frame 9 which contains two shredding rolls or rotatable members 11 and 12, and means 13 for mounting the two rolls 11 and 12 interdigitally for rotation in the frame or housing 9. To drive the rotatable members 11 and 12, a drive means including an electric motor 15 is provided. In addition, the controls for the electric motors include in addition to start and stop switches, an automatic reversing system for the shredder generally indicated by a box 16 which as mentioned above is disclosed and claimed in copending U.S. patent application Ser. No. 422,282, whose disclosure is incorporated herein by reference thereto. The controls also include a sensing means 17 which senses the level of material in a hopper or bag 18 that receives the shredded material. The drive means as mentioned hereinabove include the electric motor 15 whose output is connected by a belt 21 to a pulley 22 (FIG. 2) which is keyed on a shaft 23 of the rotatable member 11. To insure positive rotation of the other member 12, a gear connection such as a pinion gear 24 is keyed on the shaft 23 and engages a pinion gear 25 on a shaft 26 of the member 12.

In operation, documents such as 30 are introduced through a throat or slot 31 to pass between the two rotatable members 11 and 12 where they are shredded into strips and deposited in a hopper or bag 18. In the event that the bag becomes full, the sensing device 17 will create a signal which may be used to actuate an indicating light on the housing 11 and also may be utilized to stop the motor 15. In the event that too many documents are introduced to the shredding device at one time and jamming begins to occur, the large number or thick arrangement of documents will cause a slowing-down of the system which causes the reversing control 16 to reverse the drive of the motor to expel the documents back out through the throat 31. Thus, by reversing the motor a jamming of the documents is prevented. However, as mentioned hereinbefore, the present invention will prevent jamming if there is a malfunction of the reversing system 16 or even if the reversing system is not present in the shredder 10.

Figure 2:
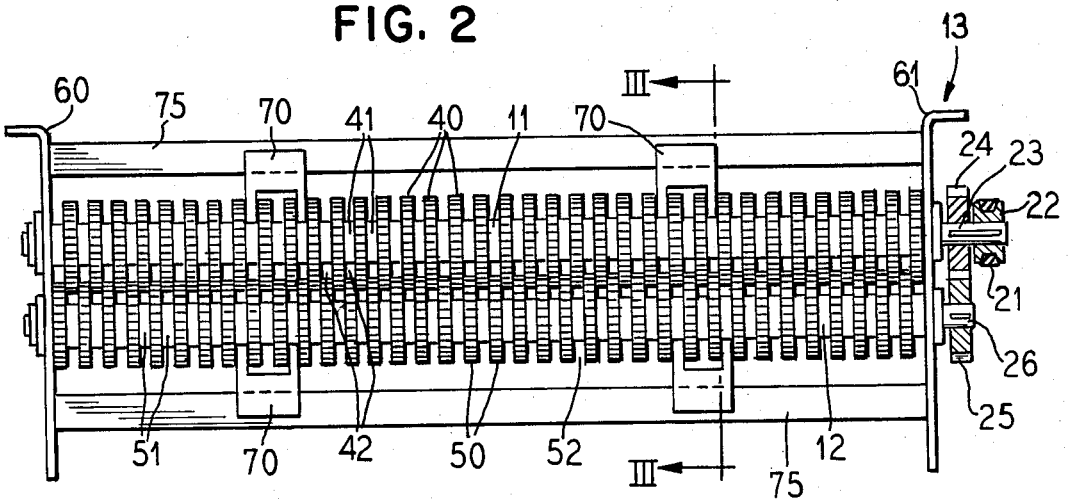
FIG. 2 is a view of the shredding members taken approximately along lines II—II of FIG. 1.
Figure 3:
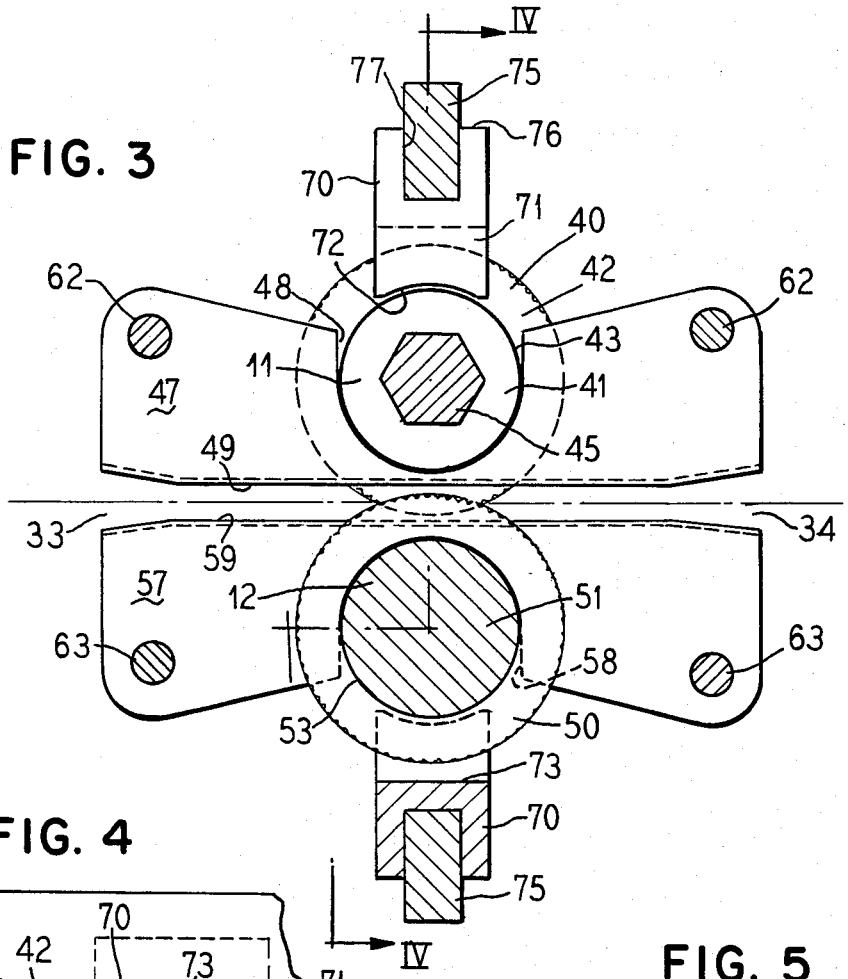
FIG. 3 is a cross-sectional view taken along lines III—III of FIG. 2.
Figure 4:
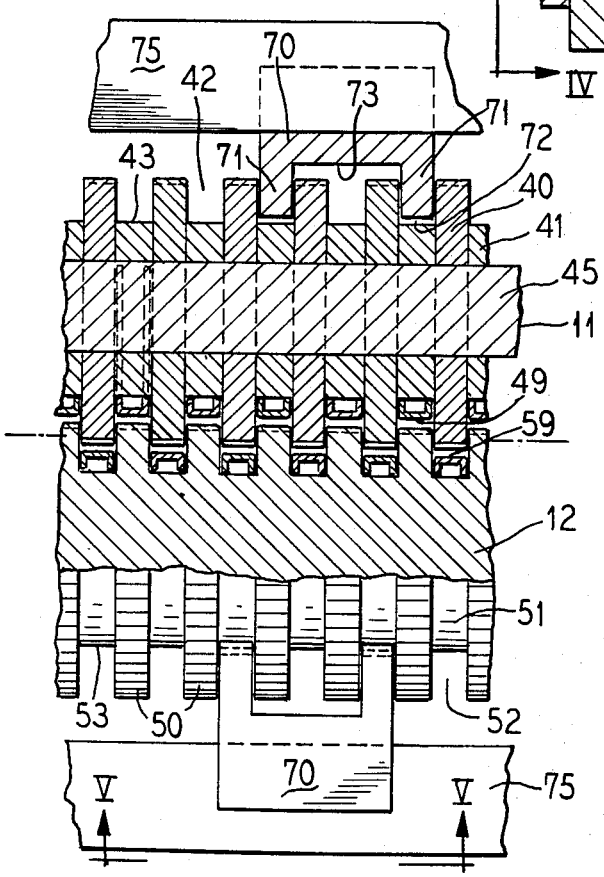
FIG. 4 is a cross-sectional view taken along lines IV—IV of FIG. 3.
Figure 5:
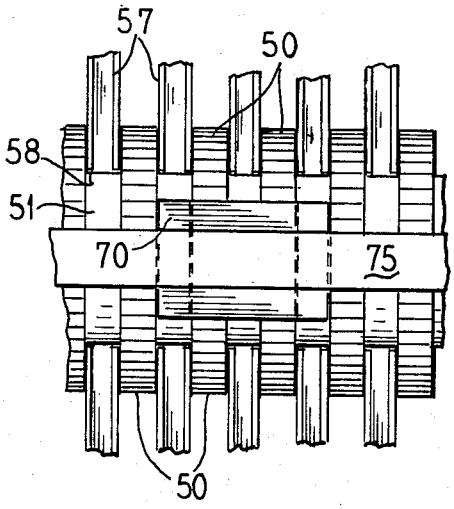
FIG. 5 is a view taken along lines V—V of FIG. 4.

As best illustrated in FIGS. 2–4, the first or upper rotatable member 11 has a plurality of first cylindrical portions or cutters 40, which are spaced apart by second cylindrical portions or spacers 41. Between two first cylindrical portions 40 and adjacent each spacer 41 an annular space 42 is formed and is radially outward of the cylindrical or peripheral surface 43 of the spacer 41 as best seen in FIG. 3. In a similar manner, the lower or second rotatable member 12 has a plurality of first cylindrical members or cutters 50 and second cylindrical members or spacers 51. The spacers are interposed between the cutters 50 so that an annular space 52 will lie between two adjacent cutters 50 and radially outward from a cylindrical or peripheral surface 53 of the spacer 51.

As best illustrated in FIGS. 3 and 4, each of the rotating members such as the member 11 can be formed by a shaft 45 on which the plurality of cylindrical members or cutters 40 and the spacers 41 have been assembled with the spacers between adjacent cutters. It is noted that the shaft has a noncylindrical cross-section such as a hexagon so that each of the cutters as well as the spacers will be positively driven. Instead of forming each of the rotatable members like the member 11, the member can be formed from a single member as illustrated by the member 12. As illustrated, the member 12 is a steel shaft which has been machined to produce the cutters 50 which are spaced from each other by smaller cylindrical diameter portions 51. It should be noted that as illustrated, each of the cutters 40 and 50 have serrated peripheral surfaces.

The mounting means 13 mounts the two rotatable members 11 and 12 as best illustrated in FIGS. 2–4 with the first cylindrical portions 40, which have a larger diameter than the second cylindrical portions 41, lying opposite the second cylindrical portions or spacers 51 of the member 12. Also, the two members 11 and 12 are mounted so that the first portions 40 extend into the annular spaces 52 between the first cylindrical portions 50 of the member 12 while the first cylindrical portions 50 extend into the annular spaces 42 and between adjacent cylindrical members or cutters 40. This interdigital arrangement provides a cutting overlap between the cylindrical cutters 40 of the member 11 and the cylindrical cutters 50 of the member 12.

In addition, guiding and stripping arrangements are provided and include a plurality of members 47 and 57. The members 47 have a cutout portion 48 so that they can be arranged in the annular space 42 with a bottom surface 49 spaced from the peripheral surface of the opposite cutter 50. In a similar manner, the member 57 has a cutout portion 48 to allow it to be mounted in the annular space 52 with a bottom surface 59 extending substantially parallel to the bottom surface 49 and spaced from the peripheral surface of the cutter or first cylindrical member 40. As illustrated in FIG. 4, each of the members 47 and 57 is formed of a sheet metal member which is bent into a U-shaped cross-section. However, they can be a single member or plate. It is also noted that each of the surfaces 49 and 50 has a tapering portion to form an incoming throat 33 and an exit throat 34.

As best illustrated in FIG. 2, each of the members 11 and 12, regardless of their particular structure, is mounted by the means 13 which comprise a pair of side plates 60 and 61 which have bearings for rotatably supporting each of the members for rotation. In addition, the side plate 60 may have rods such as 62 and 63 which are utilized to mount the members 47 and 57 that form the stripping means as best shown in FIG. 3. The side plates or members 60 and 61 are detachably connected into the frame or housing 9 of the device 10.

Figure 6:
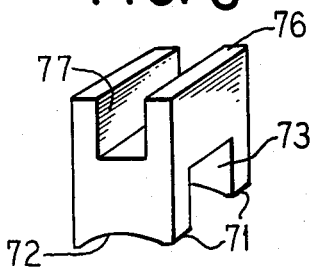
FIG. 6 is a perspective view of a yoke member in accordance with the present invention.

In order to prevent bending or deflection of the rotatable members 11 and 12 and the passage of a sheet of material between the members 11 and 12 without shredding, a backup arrangement or means is provided. As best illustrated in FIGS. 2, 3 and 4, the backup arrangement or means includes a pair of yoke members 70 which have two spaced fingers 71 which terminate in arcuate end surfaces 72 (FIG. 3). The fingers 71 are spaced apart by a gap 73 which as illustrated in FIG. 4, is large enough to receive two of the first cylindrical portions 40 as well as one spacer 41. The backup means also include means for positioning each of the yokes 70 with the end surfaces 72 of the fingers 71 either spaced from the periphery 43 by a given amount as illustrated in FIGS. 3 and 4 or engaging the peripheral surface 43. The means for mounting as best illustrated, comprises a support member 75 which has a rectangular shape and is mounted on the members 60 and 61 to extend parallel to the axes of the rotating members 11 and 12. To provide the resisting force in the right direction, the axis of the support member 75 lies in a plane formed by the axes of members 11 and 12. Each of the yoke members 70 on a surface 76, which is opposite the surfaces 72 has a groove 77 (see FIGS. 3 and 6). The groove 77 may be selected to form a tight fit with the support member 75 so that the yoke member 70 can be slid along the support member 75 to the desired position.

As illustrated in FIGS. 2, 3 and 4, the rotating member 12 is provided with support means which also consist of a support member 75 which supports two yoke members 70 with their end surfaces 72 being spaced from a periphery 53 of the second portions 51 of the member 12.

Figure 7:
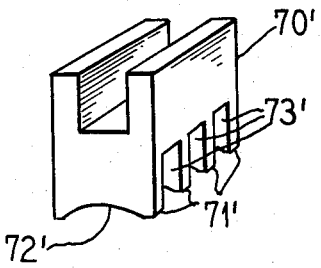
FIG. 7 is a perspective view of an embodiment of the yoke member of the present invention.

Instead of utilizing yoke members 70, an embodiment is illustrated by the yoke member 70' in FIG. 7 which embodiment has four fingers 71' each having arcuate end surfaces 72'. Adjacent fingers 71' are spaced by gap 73' which gap only has the thickness of an adjacent cutter or first cylindrical portion such as 40 or 50. The yoke member 70' may be an advantage over the yoke member 70 when the spacing between the cutters such as 40 and 50 is small.

The shredding devices 10 can utilize rotatable members 11 and 12, which will cut different sizes of strips. For example, the cylindrical portions 40 and 41 as well as 50 and 51 will have the substantially the same thickness and this thickness will determine the size of the shredded pieces of a document. For example, they may have a thickness of approximately 2 mm, 4 mm or 6 mm. Thus, the yoke member 70' may be advantageously used with a device which has the smaller thickness for the cylindrical portions while the yoke member 70 would be utilized for a device which has those having the greater thickness. The yoke members 70 and 70' may be made of a self-lubricating material. For example, the members may be made of a self-lubricating sintered bronze powder alloy.

It has also been found that two yoke members 70 are sufficient with a rotating member having a length of approximately 12–13 inches. However, when increasing the length of the rotating member to approximately 19 inches, three members are preferred. It is also contemplated utilizing the backup means only for one of the two rotating members although it is illustrated as being utilized with both. Thus, the upper or first rotating member 11 may be provided with the backup means while the member 12 is not or the member 12 may be provided with the backup means while the member 11 is not or the third arrangement is both members as illustrated are provided with the backup means.

Although various minor modifications may be suggested by those versed in the art, it should be understood that we wish to embody within the scope of the patent granted hereon, all such modifications as reasonably and properly come within the scope of our contribution to the art.

We claim:

1. An apparatus for shredding paper comprising a frame, a pair of rotatable members, each member having a plurality of first cylindrical portions and a plurality of second cylindrical portions alternately arranged along an axis of the member with the first cylindrical portions having a larger diameter than the second cylindrical portions to provide an annular space adjacent each peripheral surface of the second portion and between adjacent first cylindrical portions, means for mounting the pair of members interdigitally for rotation in the frame with the first cylindrical portions of one of the pair of members being opposite the second cylindrical portions of the other member of the pair and extending into the annular space associated therewith so that the first cylindrical portions of the pair of members overlap each other and coact to shred material passing between the pair of members, means for rotating said pair of members, stripper means operatively extending into the annular spaces between said members to guide material into the rotating members and to remove material from the rotating members, and backup means for limiting bending of at least one of the members to prevent jamming of material during a shredding operation, said backup means including at least one yoke member having at least two fingers separated by a gap, each finger having an end surface, and means for mounting the yoke member with the fingers extending into the separate annular spaces between the first cylindrical portions with the end surface of each finger being at a point adjacent the peripheral surface of a second cylindrical portion disposed therebetween so that as the rotatable member begins to bend during shredding of material, the end surfaces of the fingers of each yoke member engage the peripheral surfaces to prevent further bending of the rotatable member.

2. An apparatus according to claim 1, wherein the means for mounting the yoke member comprises a support member mounted transverse to the frame and parallel to the axes of the rotatable members and substantially in the plane thereof.

3. An apparatus according to claim 2, wherein at least two yoke members are mounted on said support member.

4. An apparatus according to claim 2, wherein the support member has a rectangular cross-section and each of said yoke members has a rectangular slot receiving said support member.

5. An apparatus according to claim 1, wherein each of the rotatable members is provided with the backup means.

6. An apparatus according to claim 1, wherein only one of the rotatable members is provided with the backup means.

7. An apparatus according to claim 1, herein each of the yoke members has only two fingers, said gap having a width approximately equal to the thickness of three first portions so that the two fingers extend into annular spaces which are spaced apart by two first cylindrical portions and a single second cylindrical portion.

8. An apparatus according to claim 1, wherein each of the yoke members has at least three fingers with the gap between said fingers being approximately equal to the thickness of said fingers.

9. An apparatus according to claim 1, wherein each of the first and second cylindrical portions of the rotatable member are integrally connected to one another.

10. An apparatus according to claim 1, wherein each of the rotatable members comprises a shaft having the first and second cylindrical portions assembled thereon.

11. In an apparatus for shredding paper comprising a frame, a pair of rotatable members each having a plurality of first cylindrical cutting portions and a plurality of second cylindrical spacing portions alternately arranged along the axis of each of the members with the cutting portions being of a larger diameter than the spacing portions, means for mounting the rotatable members for rotation in the frame with the cutting poritons of one rotatable member being opposite the spacing portions of the other member and extending into annular spaces between cutting portions of the other member so that the cutting portions of the pair of rotatable members overlap and coact to shred material passing between the pair of rotatable members, means for rotating the members and stripping means extending between the cutting portions of each rotatable member and into the annular spaces therebetween for guiding material into the cutting portions and for stripping cut material therefrom, the improvement comprising backup means for at least one of the rotatable members to prevent jamming of material during a shredding operation, said backup means including at least one yoke member having at least two fingers being separated by a gap with each finger with an end surface, and means for positioning the yoke member with the fingers extending into different annular spaces of one of the rotatable members and the end surface of each finger extending to a point adjacent a periphery of one of the second cylindrical spacing portions so that as the rotatable member beings to bend during shredding of material, each end surface engages the periphery of a spacing portion to prevent further bending of the rotatable member.

12. In an apparatus according to claim 11, wherein the means for mounting the yoke member comprises a support member mounted in the frame to extend parallel to the rotatable members.

13. In an apparatus according to claim 12, wherein the support member has a rectangular cross-section and each of the yoke members has a rectangular slot opposite the ends of the finger for adjustably mounting the yoke member on the support member.

14. In an apparatus according to claim 13, wherein each yoke member has only two fingers, said gap extending at right angles to both the slot and the support member and having a width of substantially the thickness of two cylindrical cutting portions and one spacing portion.

15. In an apparatus according to claim 13, wherein each of the yoke members has at least three fingers with the gaps extending perpendicular to the slot opposite said fingers.

16. In an apparatus according to claim 12, which includes at least two yoke members mounted on said support member.

17. In an apparatus according to claim 11, wherein each of the yoke members comprises a self-lubricating member.

18. In an apparatus according to claim 11, wherein a backup means is provided for each of said rotatable members.

19. In an apparatus according to claim 11, wherein only one of the two rotatable members is provided with the backup means.

* * * * *